US008680997B2

(12) United States Patent
Gallagher

(10) Patent No.: US 8,680,997 B2
(45) Date of Patent: Mar. 25, 2014

(54) TAUT WIRE FENCE SYSTEM

(75) Inventor: Ian Stuart Gallagher, Hamilton (NZ)

(73) Assignee: Gallagher Group Limited, Hamilton (NZ)

( * ) Notice: Subject to any disclaimer, the term of this patent is extended or adjusted under 35 U.S.C. 154(b) by 158 days.

(21) Appl. No.: 13/322,313

(22) PCT Filed: May 24, 2010

(86) PCT No.: PCT/NZ2010/000094

§ 371 (c)(1),
(2), (4) Date: Feb. 1, 2012

(87) PCT Pub. No.: WO2010/137998

PCT Pub. Date: Dec. 2, 2010

(65) Prior Publication Data

US 2012/0138883 A1 Jun. 7, 2012

(30) Foreign Application Priority Data

May 24, 2009 (NZ) ..... 573055

(51) Int. Cl.
*G08B 13/00* (2006.01)
*H01H 3/02* (2006.01)

(52) U.S. Cl.
USPC ..... 340/550; 340/541; 340/668; 200/61.93

(58) Field of Classification Search
USPC ..... 340/550, 541, 548, 564, 668; 200/61.93; 256/10
See application file for complete search history.

(56) References Cited

U.S. PATENT DOCUMENTS

| | | | | |
|---|---|---|---|---|
| 3,932,718 | A * | 1/1976 | Porat | 200/61.93 |
| 4,367,459 | A * | 1/1983 | Amir et al. | 340/541 |
| 4,628,747 | A | 12/1986 | Weitz et al. | |
| 5,392,027 | A | 2/1995 | Brunot et al. | |
| 5,852,402 | A * | 12/1998 | Perry | 340/541 |
| 6,854,337 | B1 | 2/2005 | Tarara et al. | |
| 6,891,472 | B2 | 5/2005 | Tallman | |
| 7,880,630 | B2 * | 2/2011 | Stapleton | 340/541 |
| 2013/0187784 | A1 * | 7/2013 | Malins et al. | 340/668 |

FOREIGN PATENT DOCUMENTS

| | | |
|---|---|---|
| FR | 2477309 | 9/1981 |
| GB | 2162981 A | 2/1986 |
| JP | 2000 132754 A | 5/2000 |

* cited by examiner

*Primary Examiner* — John A Tweel, Jr.
(74) *Attorney, Agent, or Firm* — Frank H. Foster; Kremblas & Foster

(57) ABSTRACT

An apparatus and method of detecting a change in tension of a taut wire fence system, where the system includes a connector including a main body member having a first attachment portion at one end of the member and a second attachment portion at the opposite end of the member and a sensor located on the main body between and aligned with the first and second attachment portions, the method including the steps of attaching a first wire of the fence to the first attachment portion and attaching the second attachment portion of the connector either to an end support mount for the fence, or to a second wire of the fence system such that the connector is held independently of direct contact with any fence support, and such that the first wire, the sensor on the main body of the connector and the second attachment portion respectively, are aligned.

16 Claims, 4 Drawing Sheets

TAUT WIRE FENCE SYSTEM

STATEMENT OF CORRESPONDING APPLICATIONS

This application is based on the Provisional Specification filed in relation to New Zealand Patent Application Number 573055, the entire contents of which are incorporated herein by reference.

TECHNICAL FIELD

The present invention relates to a method and system for use with taut wire security fence applications, and in particular, although not limited to, a system or method of sensing when there is an attempt to breach or tamper with a taut wire security fence.

BACKGROUND ART

Fence systems that are capable of sensing tamper related activity on the fence wire are well known in the containment and security industries. A taut wire security fence system is one in which one or more wires are held in tension between two end supports. An end support may be any support where the wire of the fence is terminated, such as at a fixed post or another fixed physical structure (for example, a wall). A taut wire fence may include a number of intermediate supports, but need not do so. Reference to a taut wire fence throughout this specification should be understood to include an electrified taut wire fence as well as a conventional, non-electric, taut wire fence, unless specifically stated otherwise.

One means of breaching an electric security fence is to cut the wires of the fence. This kind of breach is easily detected by electrical signals that are interrupted by a cut wire and can then sound an alarm for the particular security zone being breached.

Another method an intruder can breach an electric taut wire security fence is by climbing the fence. This can result in the fence wires deflecting downwards and connecting together as a short circuit which can be detected as loss or reduction of electrical signal through a wire.

Yet another method of breaching an electric fence is to deflect the wires of the fence, as can occur by a person climbing onto the wire or otherwise pulling the wires apart to enable an intruder or object to pass through the fence. In such instances the wires may not short or open circuit the signal through the fence. However, in both electric and conventional fences (not electrified) cutting, bending or spreading the wires changes the tension in the wires, which can be detected by a sensor.

However, in many instances a taut wire fence is not an electric fence and hence tamper activities cannot be detected through an electrical disturbance as with an electric fence. In general a system to detect an attempt to breach or tamper with a taut wire security fence would ideally work for both electric and conventional (non-electric) taut wire fences.

U.S. Pat. No. 6,646,563 (to Buckley et al) discloses a deflection system for a taut wire fence including a plate member configured such that a wire of a taut wire fence can be wound around the plate member between two attachment points, one on each side of the plate member. The plate member is pivotally mounted on an intermediate fence support (e.g., a post) such that a change of tension of the wire on either side of the plate member causes the plate member to rotate about the pivot mount. A sensor mounted on the plate member between the attachment points is used to detect a change in strain exerted on the plate as it is rotated by the change in tension in the wire. The sensor is connected to a sensor processing circuit for interrogating the sensor and raising an alarm if tampering is detected.

However, this system has a number of disadvantages, including the requirement for the device to be mounted onto a support post. Not all taut wire fence systems include intermediate support posts. Further, the location of the device on a post can enable the system to be circumvented readily by an intruder using the post as an anchor to clamp the plate member (or a wire) thus preventing the plate member from pivoting (or preventing a change in tension from being transferred to the plate member).

A further disadvantage is that the sensitivity of the sensor to a change in tension can change (decrease quite rapidly) as the plate member pivots. Thus, while the sensor may be initially more or less in line with the wires it is connected to (in fact it is never quite in line as the wires on either side of the plate member are not in line due to their being twisted around from one side of the plate member to the other), as the plate member pivots the sensor is subjected to a much smaller change in tension than would be the case if the sensor was truly in line with the wires on either side of it and stayed that way as one of the wires is deflected.

A further disadvantage with the system disclosed by Buckley et al. is that it is configured to detect a change in deflection of one or other of the wires, causing the plate member to pivot, rather than the tension itself. If, for example one (or both) of the wires on either side of the plate member is cut, the plate member would not pivot.

The device of Buckley can also create problems if for any reason the fence requires re-tensioning, as may be required from time to time for maintenance of the taut wire fence. If the plate member is retained on its pivot mount to the support post and connected to the wire, then tensioning the wire on one side will have no effect on the tension on the wire on the other side of the plate member as the pivot connection of the plate to the post prevents the plate from moving and thus transferring the tension to the wire on the other side. Re-tensioning the wires on both sides of the plate member could entail tensioning both wires to the same tension independently, or disconnection of the plate member from the wires, re-tensioning the wire and reconnecting the plate member to the wire. Either way, this process can take more time than is normally required to re-tension a fence wire.

Security systems that are in-line with the wires and are not post mounted have been disclosed in U.S. Pat. No. 5,371,488 (to Couch et al) and U.S. Pat. No. 6,891,472 (to Tallman). The devices disclosed by Couch et al. and Tallman both involve connection of two separate wires which are constrained within the device but can move relative to one another as a result of a change in tension of one or other of the wires. Both devices include sensors which are located in fixed positions relative to the housing of the device. The sensors are configured to detect when one or other of the wires moves beyond a predetermined point(s) within the housing. In other words, both devices are essentially trip devices, physically configured to detect when a wire moves within the housing beyond a predetermined amount (typically as a result of tampering with the wire) and trigger an alarm when this occurs.

A disadvantage with this type of device is that they can be readily circumvented. As both devices rely on movement of the wires relative to the housing of the device, an intruder can readily disable the devices by clamping the wires outside the device to the housing of the device, or equivalently, clamping the wires on either side of the device together so that they cannot move relative to one another. It is also not clear how the devices would perform if one or other of the connected wires were cut.

Further, the devices are not configured to measure the actual tension in the wires or how this may change over time, and therefore cannot provide information relating to the condition of the fence at all times. In particular, they are generally unable to detect the different characteristics of an attempt to tamper with the fence and a change in tension due to other events, such as an animal pushing against the wires. As both can lead to changes in tension, these devices are prone to providing false alarms (i.e. alarms raised due to events other than human tampering), One common problem with each of these devices is that the sensor or tensile force gauge does not measure the tension in the wire directly, but rather the balance of the tensions on either side of the micro switch or tensile force gauge. The sensor/gauge will therefore normally be in a neutral or zero condition. As a result, this arrangement cannot detect a change in tension by the same amount on both sides of the switch or gauge. Such changes can occur over time due to stretching of the wire or temperature variations for example, in each case reducing the effectiveness of the taut wire fence and the detection devices.

It is generally important for the tension along the wire of a taut wire fence system to be kept within a prescribed range of tensions for effective operation of the fence under the conditions and purpose for which it is to be used. A sensor/gauge system of the prior art devices discussed above cannot detect an overall change in the tension, for whatever reason, which can result in the tension dropping below the desired range without activation of an alarm.

If the wire of the fence becomes sufficiently loose over time the sensor/gauge may not detect further deflection due to tampering.

A further problem with these systems is that they can be prone to false alarms. Typically, the alarm is triggered by the device detecting a change of tension, or a change in excess of a predetermined threshold. Such systems cannot differentiate between a tension change due to a deliberate attempt to tamper, and, for example, an accidental change due to an animal pushing against the wire.

Another problem with these arrangements in general is that the wire(s) cannot be re-tensioned without disconnecting the detector from the wire. This can add time and cost to maintenance and is generally inconvenient.

Another problem is the high cost of installation of the sensors and the large number of them required when they are attached to each support post and each wire of a security fence system.

It is an object of the present invention to address the foregoing problems or at least to provide the public with a useful choice.

One object of this invention is to provide a system that can sense the tampering of security electric fence wires. Another object is to provide a system that may be easy to install and which may improve the rejection rate of false alarms and may cope with changes of tension in the wires due to temperature changes and other environmental factors which are not tamper conditions.

The preferred application of the invention is for use with electrified security fences but this should not be seen as limiting as it may be used in non electrified security fence applications as well.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

Further aspects and advantages of the present invention will become apparent from the ensuing description which is given by way of example only.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

Further aspects and advantages of the present invention will become apparent from the ensuing description which is given by way of example only.

DISCLOSURE OF INVENTION

According to one aspect of the present invention there is provided a method of detecting a change in tension of a taut wire fence system, where the fence system includes a connector including a main body member having a first attachment portion at one end of the member and a second attachment portion at the opposite end of the member, the first attachment portion being configured to attach to a first wire of the fence system, the connector including a sensor located on the main body between the first and second attachment portions, the method characterised by the steps of a) attaching a first wire of the fence to the first attachment portion of the connector and attaching the second attachment portion of the connector either to an end support mount for the fence, or to a second wire of the fence system such that the connector is held independently of direct contact with any fence support, such that the first wire, the sensor on the main body of the connector and the second attachment portion respectively, are aligned substantially in the same plane; and b) tensioning the first wire and connector; and c) sensing, by the sensor, a measure of the force exerted on the connector by the tension in the wire; and d) sending the sensed measure to a processor; and e) calculating, by the processor, a value of the force exerted on the connector; and f) outputting the calculated value of the force, wherein step c) includes sensing a change in a dimension of the main body member of the connector.

In a preferred embodiment the method includes the steps of:

g) comparing, by the processor, the calculated value of the force with a calculated value of the force from a previous measurement to determine a rate of change of the value of the force; and h) activating an alarm if the sensed value of the force is outside a preset range of allowable values, or a preset rate of change of values, for the force.

In a preferred embodiment the method includes the step of i) adjusting the tension in the wire after the alarm is activated, if necessary.

In a preferred embodiment the method includes the steps of:

j) measuring environmental data in the vicinity of the electric fence system.

k) sending the measured environmental data to the processor and using the measured environmental data in the analysis of the calculated value of the force with a preset range of allowable values, or preset rate of change of values as carried out by the processor.

In a preferred embodiment the method includes the step of:

l) comparing the calculated value of the force on one wire with the calculated value of the force on adjacent wires and activating an alarm if the difference in the sensed values of the forces is outside a preset range of allowable difference values for the forces.

Reference will be made throughout this specification to a wire fence. However, those skilled in the art will appreciate that a fence may be formed from any strand or strip of material used to form a barrier between two connection points, and that reference to a wire fence only should not be seen as limiting.

For example, the strands of a fence may be formed (without limitation) from metal, ribbon, plastic, carbon fibre or fibreglass. A wire may or may not be electrically conductive (i.e. a taut wire fence may be a conventional non-electric fence or an electric fence).

Reference to a taut wire fence system throughout this specification should be understood to refer to a fence system including a wire where the wire is tensioned. A taut wire fence system will normally extend between two end support members and may include intermediate support members. An end support member may be any suitably anchored object, for example (without limitation), it may be a post anchored into the ground, or a wall or part of a structure.

Preferably the taut wire fence system includes an electric fence. However, those skilled in the art will appreciate that the present invention may be used for both electric fence systems and conventional, non-electric fence systems, and that reference to electric fence systems throughout this specification should not be seen as limiting.

The term aligned as used throughout this specification should be understood to mean pointing in the same direction (i.e. parallel). The term "in-line" will be used to mean "on the same line".

According to another aspect of the present invention there is provided a connector for a taut wire fence system, the connector including a main body member having a first attachment portion at one end of the member and a second attachment portion at the opposite end of the member, the first attachment portion being configured to attach to a first wire of the fence system, the connector including:

a sensor in the form of a transducer or strain gauge configured to measure a change in a dimension of the main body member, characterised in that the sensor is located between the first and the second attachment portions such that the sensor and the first and second attachment portions are aligned and substantially in the same plane.

It is a key feature of the present invention that the connector is attached, as outlined in step a) of the method, to the tensioned wire and to either another tensioned wire, or more commonly, to an end support, such that the wire(s) are in line with the body of the connector at all times. This may ensure that the tension in the wire(s) is transferred directly to the connector, so that the sensor on the main body of the connector measures the response of the main body to the tensile force exerted by the tension in the wire(s). To do this the sensor is mounted on the main body of the connector so that it is aligned with the wire(s)/end support.

Furthermore, when the connector is connected on either side to a tensioned wire (i.e. not to an end support) the connector is not connected directly to any intermediate (or other) support member of the fence. A connector in this arrangement will be referred to as connected mid-span.

The main body member of a connector according to the present invention may be configured in any shape and be formed from any material, provided the shape and material enable the main body member to withstand the tensile forces applied in use by connection to the wire(s) of the fence. It may be formed as a single integral member, or may be formed from a plurality of parts which, when assembled, form a rigid body.

The main body member may be formed from a single material, or may have different portions formed from different materials. For example, some portion of the main body may be formed from a plastics material. This may be done for example to save cost, or to reduce the weight of the main body. When the connector is used with an electric fence system different materials may be used to insulate the main body of the connector and the sensor system from the high voltage of the electrified wire and to provide insulation between an end support post and the wire.

The main body member includes a first attachment portion which may be configured in any of the numerous ways commonly known and used by those skilled in the art. The main requirement is that the first attachment portion is configured to fix the wire to the connector in such a manner that in use there will be no slippage of the wire when the wire is tensioned. This may ensure that the tensile force experienced by the wire is transferred to the main body of the connector.

In a preferred embodiment the first attachment portion is electrically insulated from other portions of the connector.

Electrically insulating the first attachment portion from the other portions of the connector is particularly important for a connector for use with an electric fence system. The first attachment portion may be electrically insulated from the other portions of the connector by forming it from a non-conducting material (e.g. any non-metallic material) or by forming an insulated barrier around the first attachment portion, for example by surrounding it with a non-conducting material, thus isolating it electrically from the rest of the connector.

In some embodiments for use with electric fence systems all or part of the main body member may be made of an insulating material so that the electrified wire is insulated from an end post or end post mount (where connected) and a sensor system on the main body member.

In a preferred embodiment the second attachment portion is configured to connect to an end support mount of the fence system.

Reference to an end support mount should be understood to refer to a mounting or device (other than a wire) that is used to connect the connector to an end support of the fence. An end support mount may commonly be fixed to an end support of a fence.

In a preferred embodiment the second attachment portion is configured to engage with an end support mount such that the main body member of the connector can swivel with respect to the end support mount.

The applicants have found that a connector connected to an end support of a fence may be subjected to twisting or rotational forces particularly when the wire connected to the first attachment point is being tensioned. Configuring the connection between the main body of the connector and a fixed end support mount so that the connector may swivel with respect to the end support mount may overcome this problem while retaining the functionality of the connector for measuring the tension exerted on the main body of the connector.

In another preferred embodiment the second engagement portion is configured to connect to a second tensioned wire of the fence system.

The second engagement portion may also be used to connect to a tensioned wire of the fence, as when the connector is connected in-line to a first and a second tensioned wire.

In a preferred embodiment the second attachment portion is electrically insulated from other portions of the connector.

This embodiment is directed principally to situations where the connector is connected mid-span to an electric fence system.

The second engagement portion may or may not be configured in a similar manner to the first engagement portion. However, in this embodiment the same criteria holds as for the first engagement portion, namely, the second attachment portion is configured to fix a second wire to the connector in such a manner that in use there will be no slippage of the wire when the wire is tensioned.

Reference will be made throughout this specification to a connector that connects to a first and a second tensioned wire of the fence. It should be appreciated that this has been done for clarity as although in many applications the first and second tensioned wires may be different wires, in other applications the second tensioned wire may be a continuation of the same physical wire as the first tensioned wire. In the latter applications, which may be common in electric fence systems for example, the section of wire between the first and second attachment portions is slack, i.e., is not tensioned.

In step b) of the method the wire of the fence is tensioned after the connector(s) have been connected. This may be carried out by any of the usual methods of tensioning a wire fence as are well known to those skilled in the art.

It is implicit in this application to a taut wire fence that there will be a specified tension, or range of allowable tensions, for the wire so that the taut wire fence can function properly, for example as a security fence.

In a preferred embodiment the connector includes a tensioner.

A tensioner (i.e. any device configured to pull on an object attached to it) included in the main body of the connector may be an advantage, particularly in re-tensioning an attached wire when required, for example during maintenance of the connector or fence, as both the connector and tensioner are in the same place.

In step c) a sensor, preferably in the form of a strain gauge or transducer assembly attached to the main body member of the connector as discussed above, is configured to measure a response of the main body member to the tension provided by the wire(s). This response is related to a change in a dimension of the main body member as a result of the applied tensile force. With the sensor mounted on the main body member as outlined above, the dimension is aligned with an imaginary line between the first and second attachment portions.

In a preferred embodiment the sensor includes a thick film resistor paste.

A thick film resistor paste may be applied to the surface of the main body member, or to a plate firmly attached to the main body member, such that the dimension of the thick film resistor paste may be aligned with the taut wire and first attachment portion of the main body member. In a connector for use with an electric fence the main body member may be formed from a plastics material which may creep over time as a result of the tension applied to it by the wire. A thick film resistor paste (or other form of transducer/strain gauge) for such connectors may be mounted onto a metal plate which is fixed to the main body member (or molded into it), the sensor thus sensing a change in the main body member through an induced change in the metal plate. The applicants consider this may be a more accurate way of taking a measurement. The applicants are also aware that the rate of change of dimension due to creep of a plastic main body member may occur over a very long period, certainly in contrast to a breach or attempt to tamper, and this slow change can be taken into account when making a measurement.

The thick film resistor paste may be connected to a suitable electronic circuit, such as are well known in the art, to detect a change in resistance of the thick film resistor paste due to a change in dimension of the main body member (i.e., to a change in tension of the taut wire).

In step d) the sensed measure is sent to a processor. This is preferably by means of a data cable linking the connectors (sensors) to the processor. However, other methods are envisaged, including use of a transmitter to transmit the data wirelessly to the processor.

In a preferred embodiment the connection system includes a data cable connection to the processor.

Reference to a connection system throughout this specification should be understood to refer to the components of a system for monitoring the tension in a wire of a taut wire fence system, where the components include a conductor according to the present invention. Thus, for example, an end support mount (if used) is considered to be included in a connection system.

In practice there may be many advantages, both in cost and security, to use a processor situated remotely from the fence in a secure site. Sensed data may be sent to the processor by a data cable or through use of a transmitter (or, in a security fence application, both could be used as a form of redundancy).

A transmitter may be located on the main body of the connector, on an end support mount, or more practically a single transmitter may be located in the vicinity of an end support, the information from the sensor(s) on the connector (s) for each wire of the fence being transferred by a data cable link between the sensor (or electronics associated with the sensor) and the transmitter.

In both conventional and electric fence applications power must be supplied to the sensor system for it to operate.

In a preferred embodiment power is provided to the connector by inductive coupling.

In a preferred embodiment the sensed data is transferred from the connector to a data cable by inductive coupling.

Preferably the connector is mounted to an end support mount in the vicinity of an end support of the fence. Inductive coupling may be used to transfer power and information between a cable on the end support and the connector/sensor electronics. This may provide an advantage in removing the need for wiring between the connector/sensor electronics and the data/power cable, which may reduce costs of installation and maintenance, allow the connector to move freely (without restriction caused by the additional connected wiring) and may improve security, as the connector cannot be isolated by an intruder cutting the power and or data cables between the connector and the end support.

The processor is programmed to receive the sensed measure and to use it to calculate (in step e)) a value of the force exerted on the connector by the wire and to output the value (in step f)). This value represents a measure of the tension in the wire.

While the absolute value of tension in a wire is important, and should be kept within the operating parameters for the taut wire fence, when using the system to detect a breach or tamper attempt it is the rate of change in tension that is important.

In steps g) and h) the processor is used to compare the values of tension with a range of preset range of allowable values of tension, and as a function of time to determine the rate of change and to compare this with a preset range of allowable rates of change, and to raise an alarm if the tension, or rate of change, falls outside of the respective allowed ranges.

It is an important feature of the present invention that the tension in the wire(s) may be measured directly and as frequently as required by the operating procedures for the taut wire fence system. In particular, monitoring of the tension at frequent intervals may enable detection of changes in tension with time characteristic of different activities—for example differentiation between environmental changes (wind, temperature etc), or animals or other objects pushing against the wires, and breaching or tampering with the wires by an intruder. The ability to detect and differentiate between the different causes of changes in tension may reduce the incidence of false alarms, for example.

After the alarm has been raised the fencing system may be inspected to verify the cause of the change in tension. In some instances the tension will require adjustment, as in step i). This step may be facilitated by use of the tensioner provided on the main body of the connector.

An adjustment of tension may be required as a result of activities other than tampering, such as a wire stretching due to aging or extreme temperature changes. The processor may be programmed to adjust and correct the value of tension for these relatively long term changes (in comparison to a breach or tamper occurrence). A gradual, long term change may take the tension in a wire outside the preset range of allowed values. The processor may be programmed to recognise such changes and to output an alert that maintenance is required rather than raising an alarm which could be confused with a tamper event. This may reduce the occurrence of false alarms for tampering, while ensuring that the tension in the wires remains within the preset limits at all times.

In a preferred embodiment the connector system includes a sensor configured to sense the environment in the vicinity of the electric fence system.

The applicants have found that environmental effects, such as temperature, shading due to clouds, wind etc, may affect the tension in the wires. It is therefore important to consider these effects when analysing the values of tension and their rate of change.

In a preferred embodiment the connector system includes a sensor configured to sense temperature.

The applicants have found that the temperature in the vicinity of the taut wire fence may have a significant effect on the tension of wires in the fence system. This information may be sensed by a temperature sensor (thermocouple, etc) as in step j), transmitted to the processor and incorporated in the analysis carried out by the processor in step k) to assist with determination of the cause of a change in tension or the rate of change.

Another useful technique for detecting the cause of change in tension in a multi-wire fence is to compare the values of the tension in adjacent wires, as in step l) of the method. Again, if the values of tension calculated for adjacent wires falls outside of a preset allowed range of values an alarm is raised.

The present invention may have many advantages over the prior art systems, including:

- the ability to monitor the value of the tension in a wire as and when required, thus enabling improved monitoring of a taut wire fence system, as well as providing both and absolute value for the tension and the rate of change of tension, both of which may be important for proper operation of the fence system as well as detection of tampering; and
- the ability to measure the rate of change may allow differentiation between different activities, such as tampering (which may cause a relatively quick change) and environmental effects (which may cause a relatively slow change), for example, which may reduce the number of false alarms, as well as alerting an operator of the need for maintenance; and
- the ability to re-tension a wire of the fence system without the need to disengage the connector or otherwise disassembly the fence system; and
- the ability to re-tension a wire of the fence system without the need to disengage the connector or otherwise disassemble the fence system; and
- the connector may be used at an end support (preferred) but in at least one embodiment may be used to join wires mid-span without the need for a support post; and
- the method for detecting change in tension in a wire of a taut wire fence system, and the connectors used in the method, may be used with both conventional and electric wire fences.

BRIEF DESCRIPTION OF THE DRAWINGS

Further aspects of the present invention will become apparent from the ensuing description which is given by way of example only and with reference to the accompanying drawings in which.

BEST MODES FOR CARRYING OUT THE INVENTION

Figure 1:
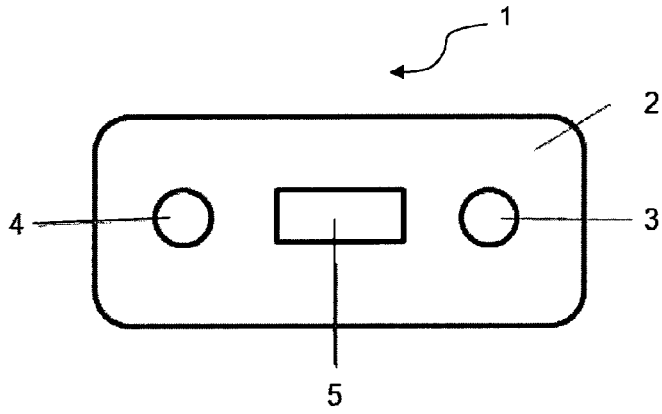
FIG. 1 shows a connector according to one embodiment of the present invention.

A connector according to one embodiment of the present invention is generally indicated by arrow one in FIG. 1. The connector 1 includes a main body member 2 which is formed as a single member from a rigid plastics material such as high density polyethylene or polyester, or a glass filled nylon material.

The main body member 2 includes a first engagement proportion 3 configured to attach to a wire (not shown) of a taught wire fence and a second engagement portion of 4 also configured to attach to a wire of the taught body fence system (not shown). When used with an electric fence system the first and second engagement portions (3 and 4) are automatically electrically insulated from the plastic main body member 2.

A sensor, 5, including a thick film resistor paste strip mounted on a metal plate which is firmly attached to the main body member 2, is located between the first (3) and second (4) engaging portions such that the first engagement portion (3), the sensor 5 and the second engagement portion (4) are aligned (and aligned with the wires of the taught wire fence when attached). The sensor 5 includes an electronic circuit (not shown) configured to measure a change in resistance of the thick film resistor paste due to a change in dimension of the metal plate/main body member 2.

Figure 2:
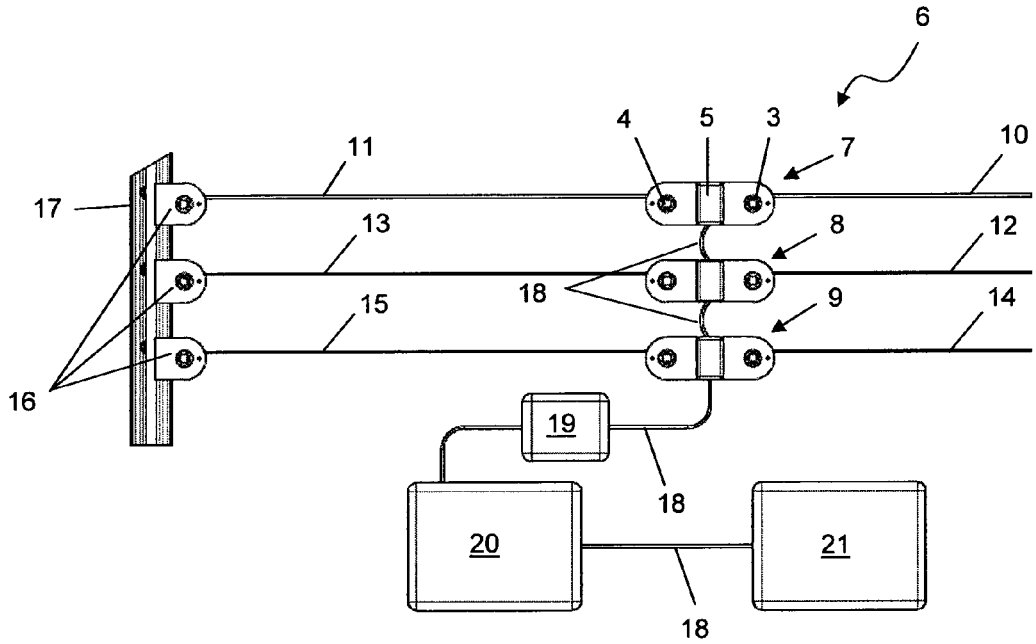
FIG. 2 shows a taut wire fence system including a connector as shown in FIG. 1.

The connector 1 is configured for connection mid span of a taught wire electric fence system, generally indicated by arrow 6, as shown schematically in FIG. 2. The taught wire electric fence system 6 illustrated schematically in FIG. 2 includes three connectors, 7, 8 and 9, which are connected mid span to wires 10 and 11, 12 and 13, and 14 and 15 respectively. The wires of the fence are terminated at end support mounts 16 (one for each wire 11, 13 and 15), the end support mounts 16 being attached to an end support member in the form of a post 17.

The sensors 5 on the connectors 7, 8 and 9 are connected by a cable 18 which provides power to the sensors 5 and communicates the sensed data to the processor 20. A single cable 18 is shown in FIG. 2 for simplicity—in some embodiments separate wires may be used for power and communications to each connector.

The cable 18 is connected to an environmental sensor in the form of a temperature sensor 19 which is configured to sense temperature in the vicinity of the taught wire electric fence system 6. Information from the sensors 5 and the temperature sensor 19 is sent to the processor 20 which is programmed to analyse the information received from the sensors 5 and 19 to provide a value of tension in each of the wires. It will be appreciated that in this mid span connection arrangement the connector 7 is connected in line with wires 10 and 11 so that the tension in the wire 10 and wire 11 is the same, and the same tension is applied to connector 7 and sensed by sensor 5.

The taught wire electric fence system 6 in this embodiment includes a monitoring control system 21. The monitoring control system 21 may be incorporated into the processor 20 or, as shown in this illustration, may be a separate unit.

Figure 3:
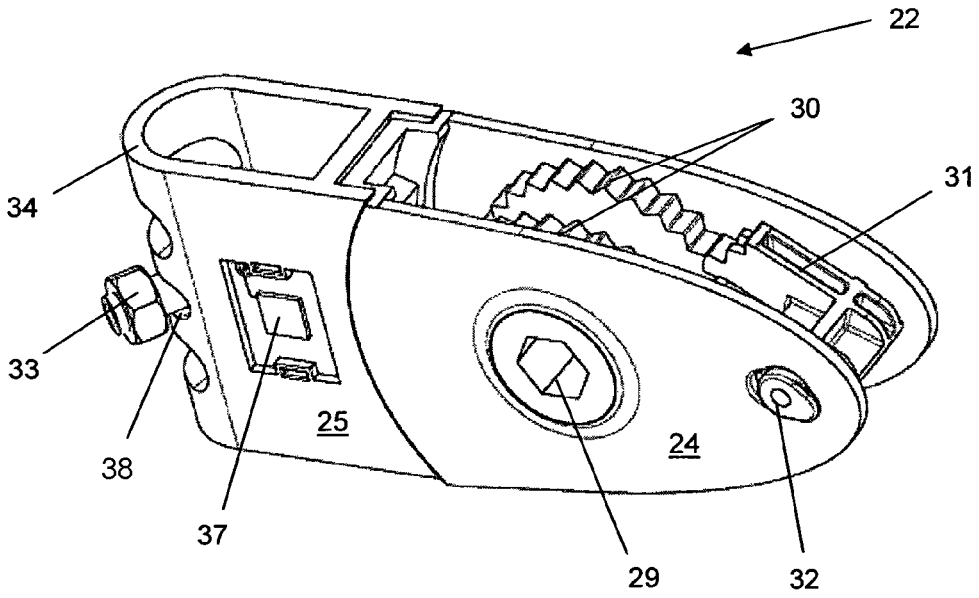
FIG. 3 shows a perspective view of a connector according to another embodiment of the present invention.
Figure 4:
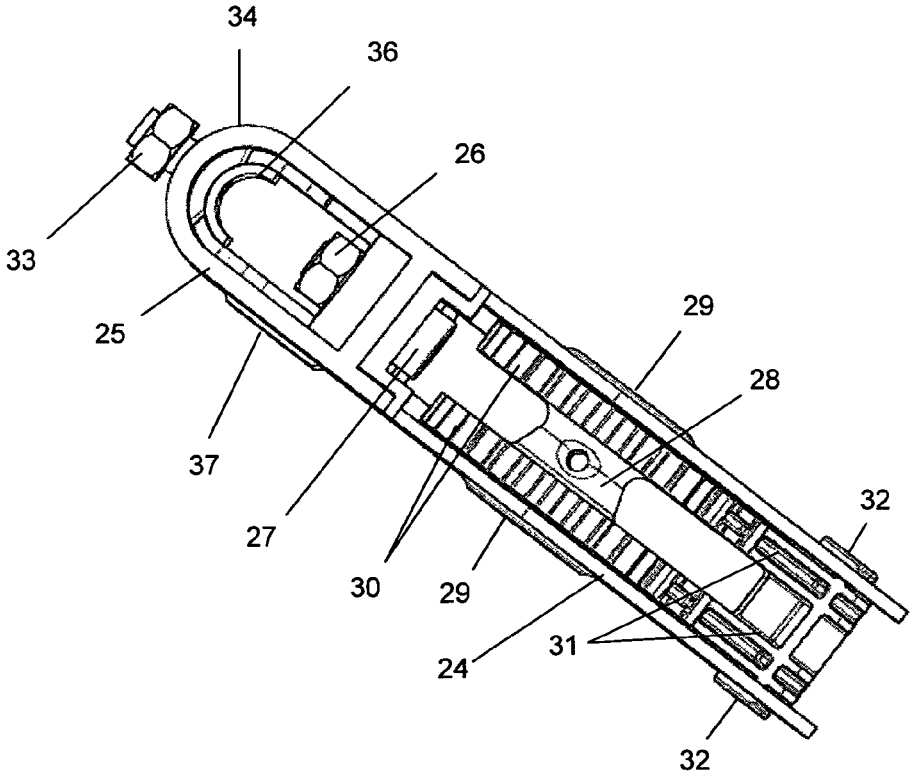
FIG. 4 shows a plan elevation of the connector shown in FIG. 3.
Figure 5:
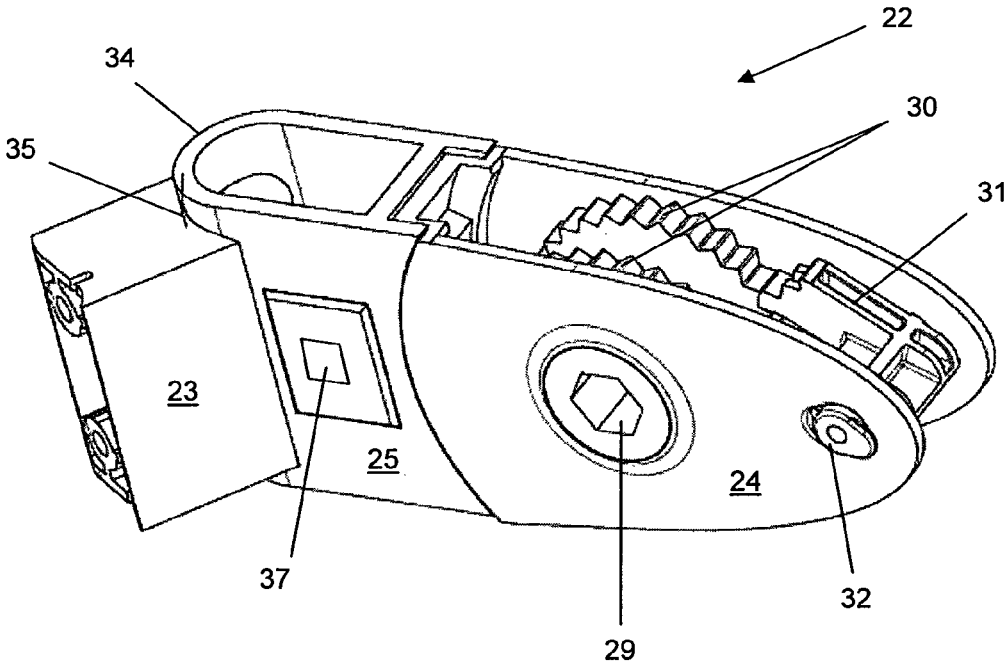
FIG. 5 shows another view of the connector of FIG. 3 attached to an end support mount.
Figure 6:
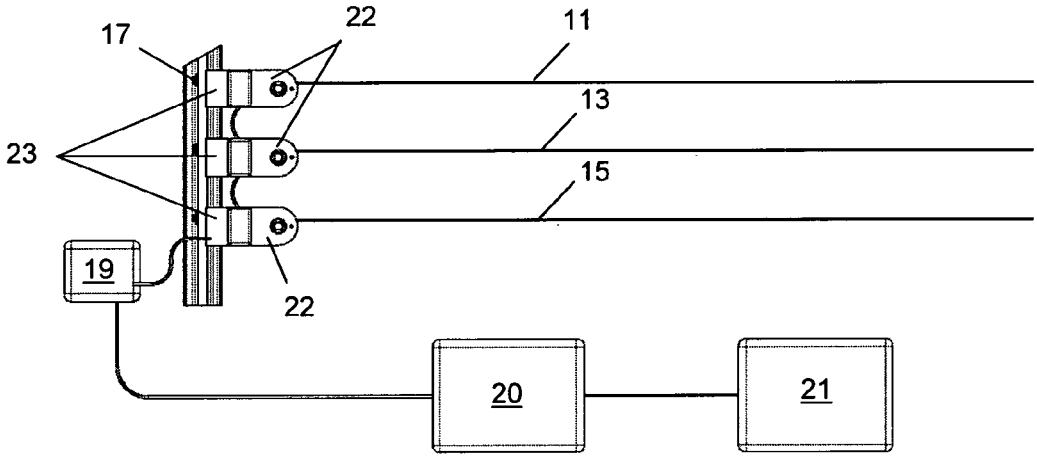
FIG. 6 shows a taut wire fence system including a connector according to the embodiment shown in FIG. 3.

A connector according to another embodiment of the present invention is generally indicated by arrow 22 in FIGS. 3 to 5. The connector 22 in this embodiment is configured to attach to an end support mount 23 as shown in FIG. 5.

The connector 22 has a main body member formed in two portions, indicated by 24 and 25, which are held rigidly together by a nut 26 and bolt 27. In other embodiments the main body may be formed integrally as a single molded piece. The two portions, 24 and 25 that together form the main body member of the connector 22 are formed from a rigid plastics material by molding.

The first engagement portion of the connector 22 includes a spool 28 to which a wire (not shown) is wound. The spool 28 is coaxially mounted on an axle 29 with a tensioner in the form of a ratchet 30 and pawl 31. The pawl 31 is mounted on an axle 32. The spool 28, ratchet 30 and pawl 31 are all formed from a plastics material and therefore insulate the wire from the main body members (whether plastics or otherwise).

The second engagement portion of the connector 22 includes a threaded coupling 33 configured to engage with a threaded bolt to attach it to the end support mount 23. An end of the second portion of the main body member 25 has a semi circular wall 34, the outer surface of the wall 34 having a shape complementary to a semi circular surface 35 on an end of the end support member 23. The threaded coupling 33 passes through a slot 38 in the end wall 34 of the second portion of the main body member 25 and is terminated inside the second part of the main body member 25 by a semi circular plate 36 having an outer radius complementary to an inner radius of the end wall 34. With this arrangement the connector 22 is configured to swivel with respect to the end support mount 23 while remaining firmly attached to it.

Figure 7:
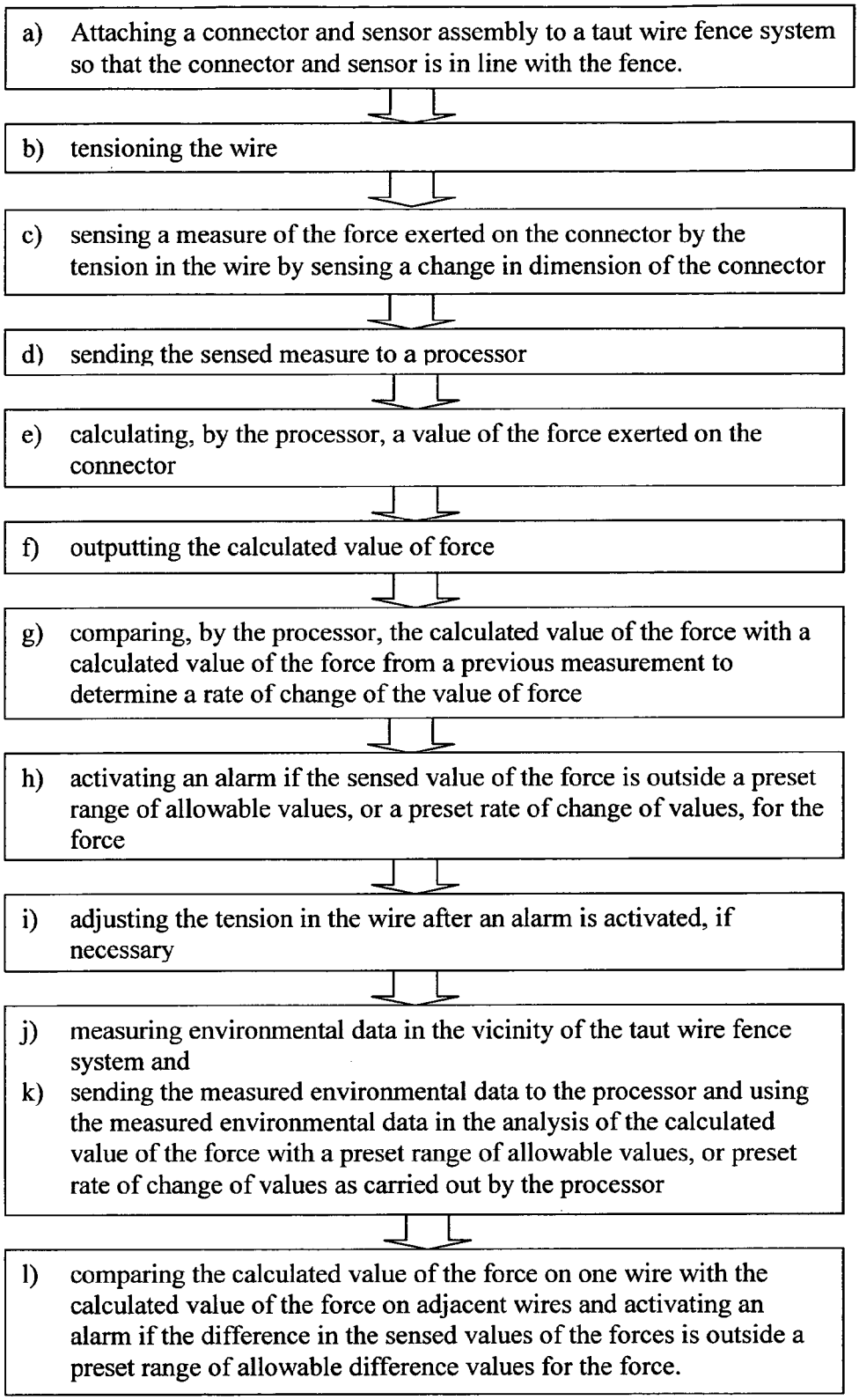
FIG. 7 shows a flowchart of the method of detecting a change in tension in a taut wire fence system according to one embodiment of the present invention.

FIG. 7 shows a flowchart of the method of the present, invention. The steps of the method were discussed in the previous section and are in general self explanatory. One point of note is that the rate of change of tension, as determined by the processor by comparison of a time series of measurements, may be a very sensitive way of differentiating tamper events from more "natural" events such as changes in temperature etc. The precision with which differentiation of the cause of change may be determined is significantly enhanced when environmental data, such as the temperature in the vicinity of the fence, is included in the analysis. The applicants have detected short term changes in tension due, for example, to a change in temperature resulting from a cloud passing a shadow over a fence. If this information is captured and used, the rate of change calculation may readily differentiate this from the effect, for example, of an intruder touching a wire.

Aspects of the present invention have been described by way of example only and it should be appreciated that modifications and additions may be made thereto without departing from the scope thereof as defined in the appended claims.

What is claimed is:

1. A method of detecting a change in tension of a taut wire fence system, where the fence system includes a connector including a main body member having a first attachment portion at one end of the member and a second attachment portion at the opposite end of the member, the first attachment portion being configured to attach to a first wire of the fence system, the connector including a sensor located on the main body between the first and second attachment portions, the method characterised by the steps of a) attaching a first wire of the fence to the first attachment portion of the connector and attaching the second attachment portion of the connector either to an end support mount for the fence, or to a second wire of the fence system such that the connector is held independently of direct contact with any fence support, such that the first wire, the sensor on the main body of the connector and the second attachment portion respectively, are aligned substantially in the same plane; and b) tensioning the first wire and connector; and c) sensing, by the sensor, a measure of the force exerted on the connector by the tension in the wire; and d) sending the sensed measure to a processor; and e) calculating, by the processor, a value of the force exerted on the wire; and f) outputting the calculated value of the force, wherein step c) includes sensing a change in a dimension of the main body member of the connector.

2. A method of detecting a change in tension of a taut wire fence system as claimed in claim 1 including the steps of:

g) comparing, by the processor, the calculated value of the force with a calculated value of the force from a previous measurement to determine a rate of change of the value of the force; and h) activating an alarm if the sensed value of the force is outside a preset range of allowable values, or a preset rate of change of values, for the force.

3. A method of detecting a change in tension of a taut wire fence system as claimed in claim 2, including the step of i) adjusting the tension in the wire after the alarm is activated, if necessary.

4. A method of detecting a change in tension of a taut wire fence system as claimed in claim 1 and further including the steps of:

j) measuring environmental data in the vicinity of the electric fence system.

5. A method of detecting a change in tension of a taut wire fence system as claimed in claim 4 wherein the step of comparing the calculated value of the force with a preset range of allowable values, or preset rate of change of values, includes using the measured environmental data.

6. A method of detecting a change in tension of a taut wire fence system as claimed in claim 1 and further including the step of:

k) comparing the calculated value of the force on one wire with the calculated value of the force on adjacent wires and activating an alarm if the difference in the sensed values of the forces is outside a preset range of allowable difference values for the forces.

7. A connector for a taut wire fence system, the connector including a main body member having a first attachment portion at one end of the member and a second attachment portion at the opposite end of the member, the first attachment portion being configured to attach to a first wire of the fence system, the connector including:

a sensor configured to measure a change in a dimension of the main body member, characterised in that the sensor is located between the first and the second attachment portions such that the sensor and the first and second attachment portions are aligned and substantially in the same plane.

8. A connector as claimed in claim 7 wherein the second attachment portion is configured to connect to a second wire of the fence system.

9. A connector as claimed in claim 7 wherein the second attachment portion is configured to connect to an end support mount of the fence system.

10. A connector as claimed in claim 9 wherein the second attachment portion is configured to engage with an end support mount such that the main body member of the connector can swivel with respect to the end support mount.

11. A connector as claimed in claim 7 and further including a tensioner.

12. A connector as claimed in claim 7 wherein the first attachment portion is electrically insulated from other portions of the connector.

13. A connector system for a taut wire fence system having a connector including a main body member having a first attachment portion at one end of the member and a second attachment portion at the opposite end of the member, the first attachment portion being configured to attach to a first wire of the fence system, the connector including:

a sensor configured to measure a change in a dimension of the main body member, characterised in that the sensor is located between the first and the second attachment portions such that the sensor and the first and second attachment portions are aligned and substantially in the same plane.

14. A connector system as claimed in claim 13 including a transmitter.

15. A connector system as claimed in claim 13 and further including a sensor configured to sense the environment in the vicinity of the electric fence system.

16. A connector system as claimed in claim 15 wherein the sensor is configured to sense temperature.

* * * * *

UNITED STATES PATENT AND TRADEMARK OFFICE

CERTIFICATE OF CORRECTION

PATENT NO. : 8,680,997 B2
APPLICATION NO. : 13/322313
DATED : March 25, 2014
INVENTOR(S) : Gallagher It is certified that error appears in the above-identified patent and that said Letters Patent is hereby corrected as shown below:

In the Specification

Column 10, delete lines 19-21 "the ability to re-tension a wire of the fence system without the need to disengage the connector or otherwise disassemble the fence system; and"

Column 10, after line 24, insert the paragraph:

--the connector is a relatively simple device in comparison with most of the prior art devices, and may be produced in a cost effective manner; and--

Signed and Sealed this
Sixteenth Day of September, 2014

Michelle K. Lee

Michelle K. Lee
*Deputy Director of the United States Patent and Trademark Office*